US005505868A

United States Patent [19]

Ryan et al.

[11] Patent Number: 5,505,868

[45] Date of Patent: Apr. 9, 1996

[54] MODIFIED DISPERSANT COMPOSITIONS

[75] Inventors: Helen T. Ryan, London; Roger Scattergood; Mark Rees, both of Reading, all of England

[73] Assignee: Ethyl Petroleum Additives Limited, Bracknell, England

[21] Appl. No.: 957,520

[22] Filed: Oct. 6, 1992

[30] Foreign Application Priority Data

Oct. 8, 1991 [EP] European Pat. Off. ..... 91-309189

[51] Int. Cl.[6] ..... C10M 103/00

[52] U.S. Cl. ..... 252/49.8

[58] Field of Search ..... 252/49.8

[56] References Cited

U.S. PATENT DOCUMENTS

| | | | |
|---|---|---|---|
| 3,511,780 | 5/1970 | Neblett et al. | 252/32.7 |
| 4,234,435 | 11/1980 | Meinhardt et al. | 252/51.5 |
| 4,428,849 | 1/1984 | Wisotsky | 252/33.4 |
| 4,857,214 | 8/1989 | Papay et al. | 252/32.5 |
| 4,873,004 | 10/1989 | Beverwijk et al. | 252/32.5 |
| 5,130,036 | 7/1992 | Burl et al. | 252/49.8 |

FOREIGN PATENT DOCUMENTS

| | | |
|---|---|---|
| 0438847 | 7/1991 | European Pat. Off. . |
| 0454380 | 10/1991 | European Pat. Off. . |

*Primary Examiner*—Raymond Henley, III
*Assistant Examiner*—Keith MacMillan
*Attorney, Agent, or Firm*—Dennis H. Rainear; William H. Thrower

[57] ABSTRACT

An oil soluble dispersant composition formed by reacting a basic nitrogen-containing ashless dispersant (i) with at least one dibasic acylating agent, (ii) with at least one phosphorus compound, and (iii) with at least one boron compound, said reactions (i), (ii) and (iii) being conducted concurrently or sequentially in any order such that the initial ashless dispersant is chemically modified via acylation in (i), by phosphorylation in (ii), and by boronation in (iii).

20 Claims, No Drawings

MODIFIED DISPERSANT COMPOSITIONS

This invention relates to novel modified ashless dispersants, to processes for their production, and to their use in liquid hydrocarbonaceous media. As used herein, the term "ashless" is used in the normal art-recognized sense of denoting that the composition is devoid of metals such as alkali or alkaline earth metals, zinc or other metals that tend to produce metal-containing residues. In this connection, boron and phosphorus are not deemed to be metals as the compositions of this invention do contain boron and phosphorus.

A continuing problem in the art of lubrication is to provide lubricant compositions which satisfy the demands imposed upon them by the original equipment manufacturers. One such requirement is that the lubricant not contribute to premature deterioration of seals, clutch face plates or other parts made from fluoroelastomers. Unfortunately, and as is well known, basic nitrogen-containing dispersants such as succinimide dispersants commonly used in oils tend to exhibit a strong adverse effect upon fluoroelastomers, by causing them to lose their flexibility and tensile strength, to become embrittled, and in severe cases, to disintegrate. Contemporary test methods for evaluating fluoroelastomer compatibility of lubricants and functional fluids are the Volkswagen P.VW 3334 Elastomer Compatibility Test, the CCMC Oil-Elastomer Seal Test (CEC L-39-T-87), and the fluoroelastomer seal test in accordance with the TO-3 Caterpillar Specification.

Methods of post-treating various nitrogen-containing dispersants with various substances are well documented in the literature. Reference may be had to the following patents for details concerning such prior art post-treating procedures: U.S. Pat. Nos. 3,087,936; 3,184,411; 3,185,645; 3,185,704; 3,200,107; 3,254,025; 3,256,185; 3,278,550; 3,280,034; 3,281,428; 3,282,955; 3,284,410; 3,312,619; 3,338,832; 3,344,069; 3,366,569; 3,367,943; 3,369,021; 3,373,111; 3,390,086; 3,458,530; 3,470,098; 3,502,677; 3,511,780; 3,513,093; 3,541,012; 3,551,466; 3,558,743, 3,573,205; 3,652,616; 3,718,663; 3,749,695; 3,865,740; 3,865,813; 3,954,639; 4,338,205; 4,401,581; 4,410,437; 4,428,849; 4,548,724; 4,554,086; 4,608,185; 4,612,132; 4,614,603, 4,615,826; 4,645,515; 4,686,054; 4,710,201; 4,713,191; 4,746,446; 4,747,850; 4,747,963; 4,747,964; 4,747,965; and 4,857,214. See also British Patents 1,085, 903 and 1,162,436.

In accordance with this invention, there is provided an oil soluble dispersant composition formed by reacting a basic nitrogen-containing ashless dispersant (i) with at least one dibasic acylating agent containing up to 12, preferably up to 8, more preferably up to 6, and most preferably 4, carbon atoms, (ii) with at least one phosphorus compound and (iii) with at least one boron compound, said reactions (i), (ii) and (iii) being conducted concurrently or sequentially in any order such that the initial ashless dispersant is chemically modified via acylation in (i), by phosphorylation in (ii), and by boronation (often referred to as "boration") in (iii). In this connection, any two or all three of the reactions (i), (ii) and (iii) can be conducted concurrently, and when two of them are conducted concurrently, the third reaction can be conducted either before or after such concurrent reaction. Whilst any phosphorus compound or compounds can be used provided it is or they are capable of reacting with the basic nitrogen-containing ashless dispersant to introduce phosphorus moieties into the dispersant, it is preferred to conduct the phosphorylation in (ii) using at least one inorganic phosphorus acid or anhydride thereof, most preferably phosphorous acid, $H_3PO_3$, or any combination thereof. Similarly any suitable boron compound or compounds can be used provided it is or they are capable of reacting with the basic nitrogen-containing ashless dispersant to introduce boron moieties into the dispersant. Desirable materials for this use include one or more boron oxides, boron halides, boron acids, ammonium salts of boron acid, boron esters, and the like. The preferred material is boric acid (also known as orthoboric acid).

The preferred acylating agents used in the reaction identified as (i) above are maleic anhydride, maleic acid, fumaric acid, malic acid or any combination of any two, any three or all four of these compounds.

Ashless dispersants utilized in the foregoing processing include hydrocarbyl succinimides, hydrocarbyl succinamides, mixed ester/amides of hydrocarbyl-substituted succinic acids, Mannich condensation products of hydrocarbyl-substituted phenols, formaldehyde and polyamines, and amine dispersants formed by reacting high molecular weight aliphatic or alicyclic halides with amines, such as polyalkylene polyamines. Mixtures of such dispersants can also be used.

Such basic nitrogen-containing ashless dispersants are well known lubricating oil additives, and methods for their preparation are extensively described in the patent literature. For example, hydrocarbyl-substituted succinimides and succinamides and methods for their preparation are described, for example, in U.S. Pat. Nos. 3,018,247; 3,018,250; 3,018,291; 3,172,892; 3,185,704; 3,219,666; 3,272,746; 3,361,673; and 4,234,435. Mixed ester-amides of hydrocarbyl-substituted succinic acid using alkanols, amines, and/or aminoalkanols are described, for example, in U.S. Pat. Nos. 3,576,743 and 4,234,435. Mannich dispersants, which are condensation products of hydrocarbyl-substituted phenols, formaldehyde and polyamines are described, for example, in U.S. Pat. Nos. 3,368,972; 3,413,347; 3,539,633; 3,697,574; 3,725,277; 3,725,480; 3,726,882; 3,798,247; and 3,803,039. Amine dispersants and methods for their production from high molecular weight aliphatic or alicyclic halides and amines are described, e.g., in U.S. Pat. Nos. 3,275,554; 3,438,757; 3,454,555; and 3,565,804.

The preferred ashless dispersants are hydrocarbyl succinimides in which the hydrocarbyl substituent is a hydrogenated or unhydrogenated polyolefin group and preferably a polyisobutene group having a number average molecular weight (as measured by gel permeation chromatography) of from 250 to 10,000, and more preferably from 500 to 5,000, and most preferably from 750 to 2,500. The ashless dispersant is most preferably an alkenyl succinimide such as is available commercially from Ethyl Petroleum Additives, Inc.; Ethyl Petroleum Additives, Ltd.; Ethyl S. A.; and Ethyl Canada Ltd. as HITEC® 644 and HITEC® 646 additives.

Another embodiment of this invention is the provision of a dispersant prepared as above having the ability when formulated in a finished engine lubricating oil of satisfying the requirements of the ASTM sequence VE engine tests for API "SG" performance (see ASTM 315 H, part III Seq. VE), and the requirements of the Volkswagen P.VW3334 Elastomer Compatibility Test and/or the requirements of the CCMC Oil-Elastomer Compatibility Test (CEC L-39-T-87) and/or the fluoroelastomer seal test in accordance with the TO-3 Caterpillar Specification.

Another embodiment of this invention involves the provision of lubricating oil additive concentrates containing an effective amount of an improved dispersant composition of this invention.

Still another embodiment of this invention is an oil of lubricating viscosity containing an effective amount of an improved dispersant composition of this invention.

Still further embodiments of this invention are processes for producing the improved dispersant compositions of this invention. One such embodiment comprises reacting a basic nitrogen-containing ashless dispersant with (i) at least one dibasic acylating agent containing up to 12, preferably up to 8, more preferably up to 6, and most preferably 4, carbon atoms, with (ii) at least one phosphorus compound preferably at least one inorganic phosphorus acid or anhydride thereof, most preferably phosphorous acid, $H_3PO_3$, and with (iii) at least one boron compound preferably at least one boron oxide, boron halide, boron acid, ammonium salt of boron acid, or boron ester, most preferably boric acid, said reactions being conducted concurrently or sequentially in any order such that the initial ashless dispersant is chemically modified via acylation, by phosphorylation and by boronation.

These and other embodiments and features of this invention will be apparent from the ensuing description and appended claims.

Basic Nitrogen-Containing Ashless Dispersants

As noted above, the process of this invention can be applied to any basic nitrogen-containing ashless dispersant susceptible to acylation, phosphorylation and boronation. Thus the process can be applied to any of the basic nitrogen-containing dispersants referred to hereinabove.

The preferred basic nitrogen-containing dispersants utilized in the practice of this invention are the hydrocarbyl succinimides. As used herein the term "succinimide" is meant to encompass the completed reaction product from reaction between a hydrocarbyl substituted succinic acylating agent and a polyamine and is intended to encompass compounds wherein the product may have amide, amidine, and/or salt linkages in addition to the imide linkage of the type that results from the reaction of a primary amino group and an anhydride moiety.

Of the succinimides, most preferred are those formed by use as one of the reactants of at least one aliphatic hydrocarbyl substituted succinic acylating agent in which the hydrocarbyl substituent contains an average of at least 40 carbon atoms. A preferred category of such acylating agents is comprised of at least one hydrocarbyl substituted succinic acylating agent in which the substituent is principally alkyl, alkenyl, or polyethylenically unsaturated alkenyl, or any combination thereof and wherein such substituent has an average of from 50 to 5000 carbon atoms. Particularly preferred for use as the acylating agent is (a) at least one polyisobutenyl substituted succinic acid or (b) at least one polyisobutenyl substituted succinic anhydride or (c) a combination of at least one polyisobutenyl substituted succinic acid and at least one polyisobutenyl substituted succinic anhydride in which the polyisobutenyl substituent in (a), (b) or (c) is derived from polyisobutene having a number average molecular weight in the range of 700 to 5,000. Commercial suppliers of polyisobutenes identify their products in terms, inter alia, of number average molecular weights. The values for number average molecular weights of polyisobutenes from any such reputable commercial supplier can be relied upon as being accurate—certainly accurate enough for selecting materials for forming polyisobutenyl succinic anhydrides or like succinic acylating agents.

As is well known, the substituted succinic acylating agents are those which can be characterized by the presence within their structure of two groups or moieties. The first group or moiety is a substituent group derived from a polyalkene. The polyalkene from which the substituted groups are derived is characterized by an $\overline{M}n$ (number average molecular weight) value of from about 500 to about 10,000, and preferably in the range of from about 700 to about 5,000.

The second group or moiety is the succinic group, a group characterized by the structure

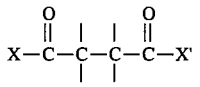

Formula I wherein X and X' are the same or different provided at least one of X and X' is such that the substituted succinic acylating agent can function as a carboxylic acylating agent. In other words, at least one of X and X' must be such that the substituted acylating agent can esterify alcohols, form amides or amine salts with ammonia or amines, form metal salts with reactive metals or basically reacting metal compounds, and otherwise functions as a conventional carboxylic acid acylating agent. Transesterification and transamidation reactions are considered, for purposes of this invention, as conventional acylation reactions.

Thus, X and/or X' is usually —OH, —O—hydrocarbyl; $—O^-M^+$ where $M^+$ represents one equivalent of a metal, ammonium or amine cation, $—NH_2$, —Cl, —Br, and together, X and X' can be —O— so as to form the anhydride. The specific identity of any X or X' group which is not one of the above is not critical so long as its presence does not prevent the remaining group from entering into acylation reactions.

Preferably, however, X and X' are each such that both carboxyl functions of the succinic group can enter into acylation reactions.

One of the unsatisfied valences in the grouping

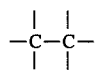

of Formula I forms a carbon-to-carbon bond with a carbon atom in the substituent group. While other such unsatisfied valence may be satisfied by a similar bond with the same or different substituent group, all but the said one such valence is usually satisfied by a hydrogen atom.

The succinic groups of the succinic acylating agents will normally correspond to the formula

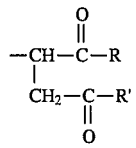

Formula II wherein R and R' are each independently selected from the group consisting of —OH, —Cl, —OR" (R"=lower alkyl), and when taken together, R and R' are —O—. In the latter case the succinic group is a succinic anhydride group. All the succinic groups in a particular succinic acylating agent need not be the same, but they can be the same. Preferably, the succinic groups will correspond to Formula III(A) or Formula III(B)

Formula III

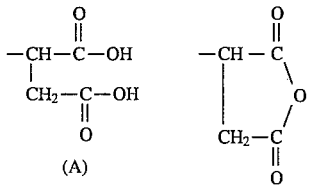

(A) (B)

or mixtures of III(A) and III(B). Production of substituted succinic acylating agents wherein the succinic groups are the same or different is within ordinary skill of the art and can be accomplished through conventional procedures such as treating the substituted succinic acylating agents themselves (for example, hydrolysing the anhydride to the free acid or converting the free acid to an acid chloride with thionyl chloride) and/or selecting the appropriate maleic or fumaric reactants.

The polyalkenes from which the substituent groups are derived are homopolymers and interpolymers of polymerisable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, the polymers used include binary copolymers, terpolymers, tetrapolymers, and the like. The polyalkenes from which the substituent groups are derived are often referred to as polyolefin(s).

The olefin monomers from which the polyalkenes are derived are polymerisable olefin monomers characterized by the presence of one or more ethylenically unsaturated groups (i.e., >C=C<); that is, they are mono-olefinic monomers such as ethylene, propylene, 1-butene, isobutene, and 1-octene or polyolefinic monomers (usually diolefinic monomers) such as 1,3-butadiene and isoprene.

These olefin monomers are usually polymerisable terminal olefins; that is, olefins characterized by the presence in their structure of the group $>C=CH_2$. However, polymerisable internal olefin monomers characterized by the presence within their structure of the group

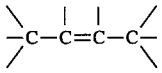

can also be used to form the polyalkenes. When internal olefin monomers are employed, they normally will be employed with terminal olefins to produce polyalkenes which are interpolymers. When a particular polymerisable olefin monomer can be classified as both a terminal olefin and an internal olefin, it is usually categorized as a terminal olefin. An example of such a monomer is 1,3-pentadiene (i.e., piperylene).

While the polyalkenes from which the substituent groups of the succinic acylating agents are derived generally are hydrocarbon polyalkenes, they can contain non-hydrocarbon groups such as lower alkoxy, lower alkyl mercapto, hydroxy, mercapto, oxo, nitro, halo, cyano, carboalkoxy (i.e.,

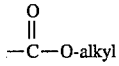

where "alkyl" is usually lower alkyl, namely an alkyl group containing up to about 7 carbon atoms), alkanoyloxy (or carbalkoxy, i.e.,

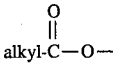

where "alkyl" is usually lower alkyl), and the like, provided the non-hydrocarbon substituents do not substantially interfere with formation of the substituted succinic acid acylating agents. When present, such non-hydrocarbon groups normally will not contribute more than about 10% by weight of the total weight of the polyalkenes. Since the polyalkene can contain such non-hydrocarbon substituents, it is apparent that the olefin monomers from which the polyalkenes are made can also contain such substituents. Normally, however, as a matter of practicality and expense, the olefin monomers and the polyalkenes used are free from non-hydrocarbon groups, except chloro groups which usually facilitate the formation of the substituted succinic acylating agents.

Although the polyalkenes may include aromatic groups (especially phenyl groups and lower alkyl- and-/or lower alkoxy-substituted phenyl groups such as p-tert-butylphenyl) and cycloaliphatic groups such as would be obtained from polymerisable cyclic olefins or cycloaliphatic substituted polymerisable acyclic olefins, the polyalkenes usually will be free from such groups. Nevertheless, polyalkenes derived from interpolymers of both 1,3-dienes and styrenes such as 1,3-butadiene and styrene or 4-tert-butyl-styrene are exceptions to this generalization. Similarly, the olefin monomers from which the polyalkenes are prepared can contain both aromatic and cycloaliphatic groups.

Generally speaking aliphatic hydrocarbon polyalkenes free from aromatic and cycloaliphatic groups are preferred for use in preparing the substituted succinic acylating agents. Particularly preferred are polyalkenes which are derived from homopolymers and interpolymers of terminal hydrocarbon olefins of 2 to about 8 carbon atoms, most especially from 2 to 4 carbon atoms. While interpolymers of terminal olefins are usually preferred, interpolymers optionally containing up to about 40% of polymer units derived from internal olefins of up to about 8 carbon atoms are also preferred. The most preferred polyalkenes are polypropylenes and polyisobutenes.

Specific examples of terminal and internal olefin monomers which can be used to prepare the polyalkenes according to conventional, well-known polymerization techniques include ethylene; propylene; 1-butene; 2-butene; isobutene; 1-pentene; 1-hexene; 1-heptene, 1-octene; 1-nonene; 1-decene; 4-methyl-1-pentene; propylene-tetramer; diisobutylene; isobutylene trimer; 1,2-butadiene; 1,3-butadiene; 1,2-pentadiene; 1,3-pentadiene; 1,4-pentadiene; isoprene; 1,5-hexadiene; 2-chloro-1,3-butadiene; 2-methyl-1-heptene; 4-cyclohexyl-1-butene; 3-pentene; 4-octene; 3,3-di-methyl-1-pentene; styrene; 2,4-dichlorostyrene; divinylbenzene; vinyl acetate; allyl alcohol; 1-methyl-vinyl acetate; acrylonitrile; ethyl acrylate; methyl methacrylate; ethyl vinyl ether; and methyl vinyl ketone. Of these, the hydrocarbon polymerisable monomers are preferred and of these hydrocarbon monomers, the terminal olefin monomers are particularly preferred.

Specific examples of polyalkenes include polypropylenes, polybutenes, ethylene-propylene copolymers, styrene-isobutene copolymers, isobutene-1,3-butadiene copolymers, propene-isoprene copolymers, isobutene-chloroprene copolymers, isobutene-4-methylstyrene copolymers, copolymers of 1-hexene with 1,3-hexadiene, copolymers of 1-octene with 1-hexene, copolymers of 1-heptene with 1-pentene, copolymers of 3-methyl-1-butene with 1-octene, copolymers of 3,3-dimethyl-1-pentene with 1-hexene, and terpolymers of isobutene, styrene and piperylene. More specific examples of such interpolymers include copolymer of 95% (by weight) of isobutene with 5% (by weight) of styrene; terpolymer of 98% of isobutene with 1% of piperylene and 1% of chloroprene; terpolymer of 95% of isobutene with 2% of 1-butene and 3% of 1-hexene; terpolymer of 60% of isobutene with 20% of 1-pentene and 20% of 1-octene; copolymer of 80% of 1-hexene and 20% of 1-heptene; terpolymer of 90% of isobutene with 2% of cyclohexene and 8% of propylene; and copolymer of 80% of ethylene and 20% of propylene. Preferred sources of polyalkenes are the polyisobutenes obtained by polymerization of $C_4$ refinery streams which contain both n-butene and isobutene in various proportions using a Lewis acid catalyst such as aluminum trichloride or boron trifluoride. These polybutenes usually contain predominantly (for example, greater than about 80% of the total repeating units) of repeating units of the configuration

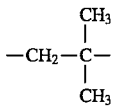

In preparing polyalkenes, conventional techniques known to those skilled in the art include suitably controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

In preparing the substituted succinic acylating agents, one or more of the above-described polyalkenes is reacted with one or more maleic or fumaric acidic reactants of the general formula

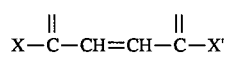

Formula IV wherein X and X' are as defined hereinbefore. Preferably the maleic and fumaric reactants will be one or more compounds corresponding to the formula

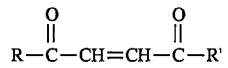

Formula V wherein R and R' are as previously defined herein. Ordinarily the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acylating agents. The most preferred reactants are maleic acid, maleic anhydride, and mixtures of these.

Any of a variety of known procedures can be used to produce the substituted succinic acylating agents. For convenience and brevity, when the term "maleic reactant" is used hereafter, the term is generic to the reactants corresponding to Formulas IV and V above including mixtures of such reactants.

One procedure for preparing the substituted succinic acylating agents is illustrated, in part, by the two-step procedure described in U.S. Pat. No. 3,219,666. It involves first chlorinating the polyalkene until there is an average of at least about one chloro group for each molecule of polyalkene. Chlorination involves merely contacting the polyalkene with chlorine gas until the desired amount of chlorine is incorporated into the chlorinated polyalkene. Chlorination is generally carried out at a temperature of about 75° C. to about 125° C. If desired, a diluent can be used in the chlorination procedure. Suitable diluents for this purpose include poly- and perchlorinated and/or fluorinated alkanes and benzenes.

The second step in the two-step chlorination procedure is to react the chlorinated polyalkene with the maleic reactant at a temperature usually within the range of about 100° C. to about 200° C. The mole ratio of chlorinated polyalkene to maleic reactant is usually about 1:1. In this connection, a mole of chlorinated polyalkene may be regarded as the the weight of chlorinated polyalkene corresponding to the $\overline{M}n$ value of the unchlorinated polyalkene. However, a stoichiometric excess of maleic reactant can be used, for example, a mole ratio of 1:2. If an average of more than about one chloro group per molecule of polyalkene is introduced during the chlorination step, then more than one mole of maleic reactant can react per molecule of chlorinated polyalkene. Accordingly, the ratio of chlorinated polyalkene to maleic reactant may be referred to in terms of equivalents, an equivalent weight of chlorinated polyalkene being the weight corresponding to the $\overline{M}n$ value divided by the average number of chloro groups per molecule of chlorinated polyalkene. The equivalent weight of a maleic reactant is its molecular weight. Thus, the ratio of chlorinated polyalkene to maleic reactant will normally be such as to provided about one equivalent of maleic reactant for each mole of chlorinated polyalkene up to about one equivalent of maleic reactant for each equivalent of chlorinated polyalkene with the understanding that it is normally desirable to provide an excess of maleic reactant; for example, an excess of about 5% to about 25% by weight. Unreacted excess maleic reactant may be stripped from the reaction product, usually under vacuum, or reacted during a further stage of the process as explained below.

The resulting polyalkenyl-substituted succinic acylating agent is, optionally, again chlorinated if the desired number of succinic groups are not present in the product. If there is present, at the time of this subsequent chlorination, any excess maleic reactant from the second step, the excess will react as additional chlorine is introduced during the subsequent chlorination. Otherwise, additional maleic reactant is introduced during and/or subsequent to the additional chlorination step. This technique can be repeated until the total number of succinic groups per equivalent weight of substituent groups reaches the desired level.

Another procedure for preparing substituted succinic acid acylating agents utilizes a process described in U.S. Pat. No. 3,912,764 and U.K. Pat. No. 1,440,219. According to that process, the polyalkene and the maleic reactant are first reacted by heating them together in a direct alkylation procedure. When the direct alkylation step is completed, chlorine is introduced into the reaction mixture to promote reaction of the remaining unreacted maleic reactants. According to the patents, 0.3 to 2 or more moles of maleic anhydride are used in the reaction for each mole of olefin polymer; i.e., polyalkene. The direct alkylation step is conducted at temperatures of 180° C. to 250° C. During the chlorine-introducing stage, a temperature of 160° C. to 225° C. is employed.

Other known processes for preparing the substituted succinic acylating agents include the one-step process described in U.S. Pat. Nos. 3,215,707 and 3,231,587. Basically, this process involves preparing a mixture of the polyalkene and the maleic reactant in suitable proportions and introducing chlorine into the mixture, usually by passing chlorine gas through the mixture with agitation, while maintaining a temperature of at least about 140° C.

Usually, where the polyalkene is sufficiently fluid at 140° C. and above, there is no need to utilize an additional substantially inert, normally liquid solvent/diluent in the one-step process. However, if a solvent/diluent is employed, it is preferably one that resists chlorination such as the poly- and per-chlorinated and/or -fluorinated alkanes, cycloalkanes, and benzenes.

Chlorine may be introduced continuously or intermittently during the one-step process. The rate of introduction of the chlorine is not critical although, for maximum utilization of the chlorine, the rate should be about the same as the rate of consumption of chlorine in the course of the reaction. When the introduction rate of chlorine exceeds the rate of consumption, chlorine is evolved from the reaction mixture. It is often advantageous to use a closed system, including superatmospheric pressure, in order to prevent loss of chlorine so as to maximize chlorine utilization.

The minimum temperature at which the reaction in the one-step process takes place at a reasonable rate is about 140° C. Thus, the minimum temperature at which the process is normally carried out is in the neighborhood of 140° C. The preferred temperature range is usually between about 160° C. and about 220° C. Higher temperatures such as 250° C. or even higher may be used but usually with little advantage. In fact, excessively high temperatures may be disadvantageous because of the possibility that thermal degradation of either or both of the reactants may occur at excessively high temperatures.

In the one-step process, the molar ratio of maleic reactant to chlorine is such that there is at least about one mole of chlorine for each mole of maleic reactant to be incorporated into the product. Moreover, for practical reasons, a slight excess, usually in the neighborhood of about 5% to about 30% by weight of chlorine, is utilized in order to offset any loss of chlorine from the reaction mixture. Larger amounts of excess chlorine may be used.

Further details concerning procedures for producing the substituted acylating agents have been extensively described in the patent literature, such as for example in U.S. Pat. No. 4,234,435. Thus, further amplification of such procedures herein is deemed unnecessary.

The other principal reactant utilized in forming the succinimides which preferably are used in the process of this invention is one or a mixture of polyamines which preferably has at least one primary amino group in the molecule and which additionally contains an average of at least two other amino nitrogen atoms in the molecule. For best results, the polyamines should contain at least two primary amino groups in the molecule.

One preferred type of polyamines is comprised of alkylene polyamines such as those represented by the formula $$H_2N\ (CH_2)_n(NH(CH_2)_n)_mNH_2$$

wherein n is 2 to about 10 (preferably 2 to 4, more preferably 2 to 3, and most preferably 2) and m is 0 to 10, (preferably 1 to about 6). Illustrative are ethylene diamine, diethylene triamine, triethylene tetramine, tetraethylene pentamine, spermine, pentaethylene hexamine, propylene diamine (1,3-propanediamine), butylene diamine (1,4-butanediamine), hexamethylene diamine (1,6-hexanediamine), decamethylene diamine (1,10-decanediamine), and the like. Particularly useful commercially-available mixtures of polyethylene polyamines are those having an overall average approximate composition falling in the range of triethylene tetramine to pentaethylene hexamine. Such mixtures typically contain straight chain, branched chain and cyclic species. Preferred for use is tetraethylene pentamine or a mixture of ethylene polyamines which approximates tetraethylene pentamine. Commercially-available mixtures of polyethylene polyamines (e.g., E-100 and S-1107 available from Dow Chemical Company) often contain minor amounts of cyclic species such as aminoalkyl-substituted piperazines and the like.

Another preferred type of polyamines is comprised of hydrocarbyl polyamines containing from 10 to 50 weight percent acyclic alkylene polyamines and 50 to 90 weight percent cyclic alkylene polyamines. Preferably such mixture is a mixture consisting essentially of polyethylene polyamines, especially a mixture having an overall average composition approximating that of polyethylene pentamine or a mixture having an overall average composition approximating that of polyethylene tetramine. Another useful mixture has an overall average composition approximating that of polyethylene hexamine. In this connection, the terms "polyalkylene" and "polyethylene", when utilized in conjunction with such terms as "polyamine", "tetramine", "pentamine", "hexamine", etc., denote that some of the adjacent nitrogen atoms in the product mixture are joined by a single alkylene group whereas other adjacent nitrogen atoms in the product mixture are joined by two alkylene groups thereby forming a cyclic configuration, i.e., a substituted piperazinyl structure. For example, the following mixture of compounds:

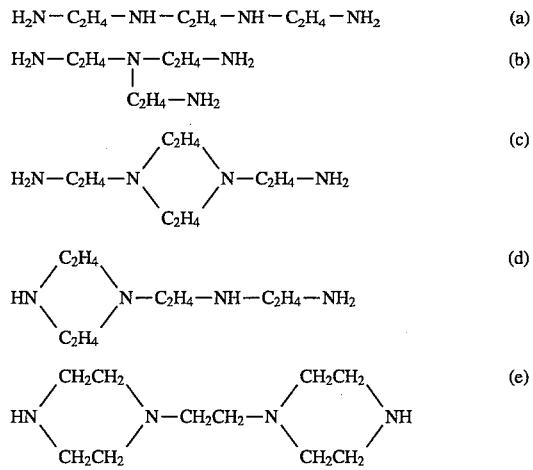

is termed herein a "polyethylene tetramine" inasmuch as its overall composition is that of a tetramine (four amino groups per molecule) in which acyclic components (a) and (b) have three ethylene groups per molecule, cyclic components (c) and (d) have four ethylene groups per molecule, and cyclic component (e) has five ethylene groups per molecule. Thus, if the above mixture contains from 10 to 50 weight percent of components (a) and (b)—or either of them—and from 90 to 50 weight percent of components (c), (d) or (e)—or any two or all three of them—it is a polyethylene tetramine suitable for use in the practice of this invention. Small amounts of lower and/or higher molecular weight species may of course be present in the mixture.

Among the preferred embodiments of this invention are formation of a succinimide product by:

1) use of a mixture of polyalkylene polyamines (10–50% acyclic; 90–50% cyclic) having an overall composition approximating that of polyalkylene pentamine and further characterized by containing on a weight basis:

a) from 2 to 10% of polyalkylene tetramines;

b) from 60 to 85% of polyalkylene pentamines;

c) from 10 to 20% of polyalkylene hexamines; and d) up to 10% lower and/or higher analogs of the foregoing.

2) use of a mixture of polyalkylene polyamines (10–50% acyclic; 90–50% cyclic) having an overall composition approximating that of polyalkylene pentamine and further characterized by containing on a weight basis:

a) at least 30% of the cyclic isomer depicted as

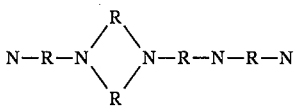

b) at least 10% of the cyclic isomer depicted as

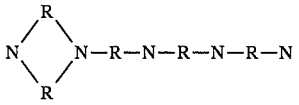

c) at least 2% of the acyclic branched isomer depicted as

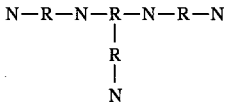

and d) at least 5% of the acyclic linear isomer depicted as 3) use of a mixture of polyalkylene polyamines (10–50% acyclic; 90–50% cyclic) having an overall composition approximating that of polyalkylene tetramine and further characterized by containing on a weight basis:

a) at least 5% linear acyclic alkylene polyamines;

b) at least 10% branched acyclic alkylene polyamines; and c) at least 60% cyclic alkylene polyamines.

4) use of a mixture of polyalkylene polyamines (10–50% acyclic; 90–50% cyclic) having an overall composition approximating that of polyalkylene tetramine and further characterized by containing on a weight basis:

a) at least 30% of the cyclic isomer depicted as

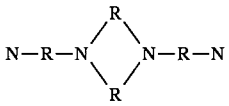

b) at least 20% of the cyclic isomer depicted as

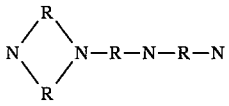

c) at least 10% of the acyclic branched isomer depicted as

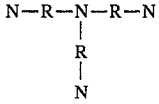

and d) at least 5% of the acyclic linear isomer depicted as

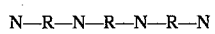

In the structural representations depicted in 2) and 4) above, R represents an alkylene group each of which contains up to 6 carbon atoms, preferably from 2 to 4 carbon atoms, and most preferably is the ethylene (dimethylene) group, i.e., the —$CH_2CH_2$— group. It is preferable, though not essential, that each R group have the same number of carbon atoms.

In the above depictions, hydrogen atoms satisfying the trivalent character of the nitrogen atoms are not shown. Thus, when R is ethylene, the depiction

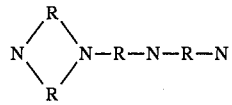

is a simplified version of the formula:

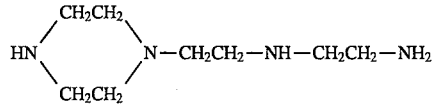

Also suitable are aliphatic polyamines containing one or more ether oxygen atoms and/or one or more hydroxyl groups in the molecule. Mixtures of various polyamines of the type referred to above are also suitable.

In principle, therefore, any polyamine having at least one primary amino group and an average of at least three amino nitrogen atoms in the molecule can be used in forming the succinimide utilized in the practice of this invention. As noted above, product mixtures known in the trade as "triethylene tetramine", "tetraethylene pentamine", and "pentaethylene hexamine" are most preferred.

In forming the initial preferred succinimide used in the practice of this invention mole ratios of the hydrocarbyl substituted succinic acylating agent to polyamine reactant ranges from about 1:1 to about 4:1, and preferably from about 1.5:1 to about 3:1.

Dibasic Acylating Agent

A wide variety of dibasic acylating agents can be reacted with the basic nitrogen-containing ashless dispersant (e.g., succinimide, Mannich reaction product, succinic acid esteramide, etc.) in the reaction of (i) above. The principal requirement is that such acylating agent contain at most 12 carbon atoms in the molecule, preferably up to 8 carbon atoms in the molecule, and more preferably up to 6 carbon atoms in the molecule. The most preferred acylating agents for use in reaction (i) contain 4 carbon atoms in the molecule. Thus use can be made of dibasic acids and anhydrides, esters and acyl halides thereof which contain a total of up to 12 carbon atoms in the molecule (excluding carbon atoms of an esterifying alcohol). Among such compounds are azelaic acid, adipic acid, succinic acid, lower alkyl-substituted succinic acid, succinic anhydride, lower alkyl-substituted succinic anhydride, glutaric acid, pimelic acid, suberic acid, sebacic acid, and like dibasic acids, anhydrides, acyl halides, and esters which contain (excluding carbon atoms of esterifying alcohols) up to 12 carbon atoms in the molecule. Preferred are maleic acid, maleic anhydride, fumaric acid and malic acid. Most preferred is maleic anhydride.

Phosphorus Compounds

Another reactant(s) with which the basic nitrogen-containing dispersant is reacted either before, during or subsequent to reaction with the above dibasic acylating agent and/or the ensuing boron compound(s) is a phosphorus compound or mixture of phosphorus compounds capable of introducing phosphorus-containing species into the ashless dispersant undergoing such reaction. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as the mono-, di-, and tri esters of phosphoric acid, thiophosphoric acid, dithiophosphoric acid, trithiophosphoric acid and tetrathiophosphoric acid; the mono-, di-, and tri esters of phosphorous acid, thiophosphorous acid, dithiophosphorous acid and trithiophosphorous acid; the trihydrocarbyl phosphine oxides; the trihydrocarbyl phosphine sulphides; the mono- and dihydrocarbyl phosphonates, (RPO(OR')(OR") where R and R' are hydrocarbyl and R" is a hydrogen atom or a hydrocarbyl group), and their mono-, di- and trithio analogs; the mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2(HPO_3)$, and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$) , hypophosphorous acid ($H_3PO_2$, sometimes called phosphinic acid), pyrophosphorous acid ($H_4P_2O_5$, sometimes called pyrophosphonic acid), phosphinous acid ($H_3PO$), tripolyphosphoric acid ($H_5P_3O_{10}$), tetrapolyphosphoric acid ($H_6P_4O_{13}$), trimetaphosphoric acid ($H_3P_3O_9$), phosphorus trioxide, phosphorus tetraoxide, phosphorus pentoxide, and the like. Partial or total sulphur analogs such as phosphorotetrathioic acid ($H_3PS_4$), phosphoromonothioic acid ($H_3PO_3S$), phosphorodithioic acid ($H_3PO_2S_2$), phosphorotrithioic acid ($H_3POS_3$), phosphorus sesquisulfide, phosphorus heptasulfide, and phosphorus pentasulfide ($P_2S_5$, sometimes referred to as $P_4S_{10}$) can also be used in forming products suitable for use as component b) in the practice of this invention. Also usable, though less preferred, are the inorganic phosphorus halide compounds such as $PCl_3$, $PBr_3$, $POCl_3$, $PSCl_3$, etc. The preferred phosphorus reagent is phosphorous acid, ($H_3PO_3$).

Likewise use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", $RP(O)(OR)_2$, and "secondary", $R_2P(O)(OR)$), esters of phosphinic acids, phosphonyl halides (e.g., $RP(O)Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)—O—P(O)(OR)_2$), and the total or partial sulphur analogs of any of the foregoing organic phosphorus compounds, and the like wherein each hydrocarbyl group contains up to about 100 carbon atoms, preferably up to about 50 carbon atoms, more preferably up to about 24 carbon atoms, and most preferably up to about 12 carbon atoms. Also usable, although less preferred, are the halophosphine halides (e.g., hydrocarbyl phosphorus tetrahalides, dihydrocarbyl phosphorus trihalides, and trihydrocarbyl phosphorus dihalides), and the halophosphines (monohalophosphines and dihalophosphines).

When using an organic phosphorus compound, it is preferable to use a water-hydrolyzable phosphorus compound—especially a water hydrolyzable dihydrocarbyl hydrogen phosphite—and water in the phosphorylation reaction so that the phosphorus compound is partially (or completely) hydrolyzed during the reaction.

Boron Compounds

The other reactant(s) with which the basic nitrogen-containing dispersant is reacted either before, during or subsequent to reaction with the above dibasic acylating agent and/or the above phosphorus reactant is a boron compound or mixtures of boron compounds capable of introducing boron-containing species into the ashless dispersant undergoing the reaction. Any boron compound, organic or inorganic, capable of undergoing such reaction can be used. Accordingly use can be made of boron oxide, boron oxide hydrate, boron trifluoride, boron tribromide, boron trichloride, $HBF_4$ boron acids such as boronic acid (e.g., alkyl-$B(OH)_2$ or aryl-$B(OH)_2$), boric acid, (i.e., $H_3B_3$), tetraboric acid (i.e., $H_2B_5O_7$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron trifluoride-phenol, boron trifluoride-phosphoric acid, boron trichloride-chloroacetic acid, boron tribromide-dioxane, and boron trifluoride-methyl ethyl ether.

Specific examples of boronic acids include methyl boronic acid, phenyl-boronic acid, cyclohexyl boronic acid, p-heptylphenyl boronic acid and dodecyl boronic acid.

The boron acid esters include especially mono, di-, and tri-organic esters of boric acid with alcohols or phenols such as, e.g., methanol, ethanol, isopropanol, cyclohexanol, cyclopentanol, 1-octanol, 2-octanol, dodecanol, behenyl alcohol, oleyl alcohol, stearyl alcohol, benzyl alcohol, 2-butyl cyclohexanol, ethylene glycol, propylene glycol, trimethylene glycol, 1,3-butanediol, 2,4-hexanediol, 1,2-cyclohexanediol, 1,3-octanediol, glycerol, pentaerythritol, diethylene glycol, carbitol, Cellosolve, triethylene glycol, tripropylene glycol, phenol, naphthol, p-butylphenol, o,p-diheptylphenol, n-cyclohexylphenol, 2,2-bis-(p-hydroxyphenyl)propane, polyisobutene (molecular weight of 1500)-substituted phenol, ehtylene chlorohydrin, o-chlorophenol, m-nitrophenol, 6-bromo-octanol, m-nitrophenol, 6-bromo-octanol, m-nitrophenol, 6-bromo-octanol, and 7-keto-decanol. Lower alcohols, 1,2-glycols, and 1,3-glycols, i.e., those having less than about 8 carbon atoms are especially useful for preparing the boric acid esters for the purpose of this invention.

Reaction Conditions

In conducting the foregoing reactions, any temperature at which the desired reaction(s) occur at a satisfactory reaction rate can be used. Ordinarily, the acylation reaction between the basic nitrogen-containing dispersant (phosphorylated or non-phosphorylated and boronated or non-boronated) and the dibasic acylating agent is conducted at temperatures in the range of 80° to 200° C., more preferably 140° to 180° C. The phosphorylation reaction and the boronation reaction (whether conducted concurrently or separately) are likewise normally performed at temperatures within either of the foregoing ranges. However, departures from these ranges can be made whenever deemed necessary or desirable. These reactions may be conducted in the presence or absence of an ancillary diluent or liquid reaction medium, such as a mineral lubricating oil solvent. If the reaction is conducted in the absence of an ancillary solvent of this type, such is usually added to the reaction product on completion of the reaction. In this way the final product is in the form of a convenient solution in lubricating oil and thus is compatible with a lubricating oil base stock. Suitable solvent oils include lubricating oils having a viscosity (ASTM D 445) of 2 to 40, preferably 3 to 12 centistokes (cSt) at 100° C., with the primarily paraffinic mineral oils such as Solvent 100 Neutral being particularly preferred. Other types of lubricating oil base stocks can be used, such as synthetic lubricants including polyesters, poly-α-olefins, and the like. Blends of mineral oil and synthetic lubricating oils are also suitable for various applications in accordance with this invention.

The proportions of the reactants will to some extent be dependent on the nature of the basic-nitrogen containing dispersant being utilized, principally the content of basic nitrogen therein. Thus optimal proportions may, in some cases, be best defined by performing a few pilot experiments. Generally speaking, however, the dibasic acylating agent is employed in amounts ranging from about 0.01 to about 0.5 moles per average equivalent of nitrogen in the initial ashless dispersant(s), with the proviso that the resultant product contains at least 0.05 equivalent of basic nitrogen. Preferably the amount of dibasic acylating agent employed ranges from about 0.02 to about 0.3 moles per average equivalent of nitrogen in the initial ashless dispersant with the proviso that the resultant product contains at least 0.1 equivalent of basic nitrogen. In the case of use of a succinimide as the initial ashless dispersant, it is preferred to utilize an amount of the dibasic acylating agent such that the total mole ratio of (a) dibasic acylating agent plus (b) the aliphatic hydrocarbyl substituted succinic acylating agent used in forming the initial succinimide falls in the range of from 1.5 to 3.5 moles of (a) and (b) per mole of polyamine, more preferably 1.6 to 2.8 moles of (a) and (b) per mole of polyamine, and most preferably 1.6 to 2.2 moles of (a) and (b) per mole of polyamine. Here again, departures from such proportions may be utilized if found efficacious in any given situation.

In the case of the phosphorus reactant, the amounts used should be sufficient to introduce up to about 5% and preferably from about 0.05 to about 2.5% of phosphorus (expressed as weight % of elemental phosphorus) into the overall final co-reacted dispersant.

In the case of the boron reactant, the amounts used should be sufficient to introduce up to about 5% and preferably from about 0.05 to about 2.5% of boron (expressed as weight % of elemental boron) into the overall final co-reacted dispersant.

It will be understood of course that in any given case the amount of dibasic acylating agent, phosphorus compound and boron compound used should be sufficient to provide a product having both satisfactory fluoroelastomer compatibility and adequate dispersancy performance.

Modified Processing

As noted above, the dispersants of this invention are formed by subjecting a basic nitrogen-containing ashless dispersant to three reactions, namely, acylation with at least one dibasic acylating agent, phosphorylation with at least one phosphorylation reagent, and boronation with at least one boronation reagent. Ordinarily these reactions will be conducted either concurrently or in sequence. It is, of course, not necessary that these reactions be conducted in the same plant or at periods of time proximate to each other. For example, in one embodiment of this invention, a phosphorylated basic nitrogen-containing ashless dispersant from one manufacturer need only be subjected to acylation with a dibasic acylating agent of the type described hereinabove and to boronation with a boronating agent of the type described hereinabove in order to produce a novel phosphorylated-acylated-boronated ashless dispersant of this invention. Likewise, one may procure a suitable acylated basic nitrogen-containing ashless dispersant from a given supplier (i.e., a basic nitrogen- containing ashless dispersant which has been subjected to acylation with a dibasic acylating agent of the type described hereinabove) and subject the same to phosphorylation and boronation in order to produce a novel acylated-phosphorylated-boronated ashless dispersant of this invention. Similarly one may procure a suitable boronated basic nitrogen-containing ashless dispersant from a given supplier and subject the same to acylation and phosphorylation in accordance with the procedures described herein to thereby produce a novel boronated-acylated-phosphorylated ashless dispersant of this invention. In short, the novel products of this invention can be produced in accordance with this invention by two or more distinct and separate parties, if desired.

Although it is preferred to use separate and distinct phosphorus compounds and boron compounds in effecting the phosphorylation and boronation reactions, it is possible to employ compounds which contain both phosphorus and boron in the molecule such as borophosphates, etc., in order to concurrently phosphorylate and boronate the ashless dispersant.

Further Treatments

Although ordinarily unnecessary, the acylated, phosphorylated, boronated ashless dispersants of this invention can be reacted with one or more additional treating agents, either before, during or after any of the above-referred-to acylation, phosphorylation and boronation reactions. Treating agents used for this purpose include, for example, carbon disulphide, hydrogen sulphide, sulphur, sulphur chloride, alkenyl cyanides, mono-, tri-, tetra-, etc. carboxylic acid acylating agents, aidehyde, ketones, urea, thiourea, guanidine, dicyanodiamide, hydrocarbyl thiocyanates, hydrocarbyl isocyanates, hydrocarbyl isothiocyanates, epoxides, episulphides, formaldehyde or formaldehyde producing compounds plus phenols, sulphur plus phenols, and many others.

Since treating processes involving numerous treating reagents are known as regards treatment of various ashless dispersants, further details concerning such technology are readily available in the literature. For example, reference may be had to the following patents for details concerning such prior art treating procedures: U.S. Pat. Nos. 3,087,936; 3,184,411; 3,185,645; 3,185,647; 3,185,704; 3,189,544; 3,200,107; 3,216,936; 3,245,908; 3,245,909; 3,245,910; 3,254,025; 3,256,185; 3,278,550; 3,280,034; 3,281,428; 3,282,955; 3,284,409; 3,284,410; 3,312,619; 3,338,832; 3,342,735; 3,344,069; 3,366,569; 3,367,943; 3,369,021; 3,373,111; 3,390,086; 3,403,102; 3,415,750; 3,455,831; 3,455,832; 3,458,530; 3,470,098; 3,502,677; 3,511,780;

3,513,093;. 3,519,564; 3,533,945; 3,541,012; 3,546,243; 3,551,466; 3,558,743; 3,573,205; 3,579,450; 3,639,242; 3,649,229; 3,652,616; 3,658,836; 3,692,681; 3,703,536; 3,708,522; 3,718,663; 3,749,695; 3,859,318; 3,865,740; 3,865,813; 3,865,740; 3,954,639; 4,338,205; 4,379,064; 4,401,581; 4,410,437; 4,428,849; 4,455,243; 4,482,464; 4,548,724; 4,521,318; 4,554,086; 4,579,675; 4,608,185; 4,612,132; 4,614,522; 4,614,603; 4,615,826; 4,617,137; 4,617,138; 4,631,070; 4,636,322; 4,645,515; 4,647,390; 4,648,886; 4,648,980; 4,652,387; 4,663,062; 4,663,064; 4,666,459; 4,666,460; 4,668,246; 4,699,724; 4,670,170; 4,710,201; 4,713,189; 4,713,191; 4,746,446; 4,747,850; 4,747,963; 4,747,964; 4,747,965; 4,857,214; 4,927,562; 4,948,386; 4,963,275; 4,963,278; 4,971,598; 4,971,711; 4,973,412; 4,981,492; 5,026,495; 5,030,249; 5,030,369; and 5,039,307. See also British Patents 1,065,595; 1,085,903; 1,153,161; 1,162,436; 2,140,811 as well as EP 0,438,849.

Uses

The novel compositions of this invention can be used as ashless dispersants in a wide variety of oleaginous fluids and as detergents or deposit reducers in hydrocarbonaceous fuels such as gasoline, diesel fuel, kerosene, burner fuel, gas oil, jet fuel, turbine fuel, and the like. They can be used in lubricating oil and functional fluid compositions, such as automotive crankcase lubricating oils, automatic transmission fluids, gear oils, hydraulic oils, cutting oils, etc. The lubricant may be a mineral oil, a synthetic oil, a natural oil such as a vegetable oil, or a mixture thereof, e.g. a mixture of a mineral oil and a synthetic oil. Suitable mineral oils include those of appropriate viscosity refined from crude oil of any source including Gulf Coast, Midcontinent, Pennsylvania, California, Alaska, Middle East, North Sea and the like. Standard refinery operations may be used in processing the mineral oil.

Synthetic oils include both hydrocarbon synthetic oils and synthetic esters. Useful synthetic hydrocarbon oils include liquid α-olefin polymers of appropriate viscosity. Especially useful are hydrogenated or unhydrogenated liquid oligomers of $C_6$–$C_{16}$ α-olefins, such as hydrogenated or unhydrogenated α-decene trimer. Alkyl benzenes of appropriate viscosity, e.g. didodecylbenzene, can also be used.

Useful synthetic esters include the esters of monocarboxylic and polycarboxylic acids with monohydroxy alcohols and polyols. Typical examples are didodecyl adipate, trimethylolpropane tripelargonate, pentaerythritoltetracaproate, di-(2-ethylhexyl) adipate, and dilauryl sebacate. Complex esters made from mixtures of mono- and dicarboxylic acids and mono- and/or polyhydric alkanols can also be used.

Typical natural oils that may be used include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and the like. Such oils may be partially or fully hydrogenated, if desired.

Viscosity index improvers may be included in the mineral, synthetic and natural oils (or any blends thereof) in order to achieve the viscosity properties deemed necessary or desirable.

The finished lubricating oil compositions and additive concentrates of this invention containing the present ashless dispersant systems will usually also contain other well-known additives in order to partake of their special properties. Among the numerous additives which can be employed in the lubricants and functional fluids and additive concentrates of this invention are those of the types described hereinafter.

The lubricants and functional fluids of this invention are of particular utility in applications wherein the oil of lubricating viscosity comes in contact with fluoroelastomers. In such applications, the compatibility of the lubricant or functional fluid of this invention so utilized, is significantly enhanced as compared to the corresponding lubricant or functional fluid containing the corresponding untreated basic nitrogen-containing ashless dispersant.

The concentrations of the ashless dispersants of this invention in oleaginous fluids will generally fall in the range of up to about 10 weight percent, for example 1 to 9 weight percent. When used in fuel compositions, amounts of up to about 5 weight percent are typical.

The following examples, in which all parts and percentages are by weight, illustrate, but do not limit, and should not be construed as limiting, the practice of this invention.

EXAMPLE 1

In a first stage reaction, polyisobutenylsuccinic anhydride (PIBSA) formed from polyisobutylene (number average molecular weight=1300) and tetraethylene pentamine (TEPA) in a mole ratio of 1.8:1 were reacted at 165°–170° C. for 4 hours. In a second stage reaction, maleic anhydride (MA) was added to the first stage reaction product in amount equivalent to 0.35 mole per mole of TEPA used in the first stage and the resultant mixture was heated at 165°–170° C. for 1.5 hours after which oil was added. In a third stage reaction, boric acid followed by $H_3PO_3$ was added to the second stage reaction mixture at a temperature of 105° C. in amounts corresponding to 1.6 and 1.21 moles respectively per mole of TEPA initially employed. The mixture was stirred at 105° C. for two hours and then heated to 155° C. and a vacuum of 40 mm applied to remove water formed in the third stage reaction. The resulting succinimide is acylated, phosphorylated, and boronated, and had a nitrogen content of 1.75%, a phosphorus content of 1.02%, and a boron content of 0.43%.

EXAMPLE 2

The procedure of Example 1 was repeated except that the amount of $H_3PO_3$ was reduced to 0.6 moles per mole of TEPA initially used. The final product, diluted to 1.74% nitrogen content with 100 solvent neutral mineral oil contains 0.40% phosphorus and 0.49% boron.

EXAMPLE 3

Repetition of Example 1 wherein the amount of $H_3PO_3$ was still further reduced to 0.3 moles per mole of TEPA initially used yielded a concentrate (diluted as in Example 1) having a phosphorus content of 0.23% and a boron content of 0.40%.

EXAMPLE 4

Example 1 was repeated but the boric acid and phosphorus acid were added at 155° C. instead of 105° C. After stirring for two hours the mixture was stripped as before. The product concentrate (diluted as in Example 1) contains 1.05% phosphorus and 0.45% boron.

EXAMPLE 5

The procedure of Example 1 is repeated except that the reaction with the boric acid and phosphorous acid is conducted before the reaction with maleic anhydride and the amounts used correspond to 1.6 and 1.21 moles respectively per mole of TEPA used in the first stage reaction. The final product (diluted as in Example 1) contains 0.40% phosphorus, 0.97% boron and 1.76% nitrogen.

EXAMPLE 6

Example 5 is repeated except that the maleic anhydride, boric acid, and phosphorous acid are concurrently reacted with the succinimide formed in the first stage reaction. One such product on dilution with 100 solvent neutral mineral oil contained 1.74% nitrogen and 0.34% phosphorus.

EXAMPLE 7

In the first stage reaction, polyisobutenylsuccinic anhydride (PIBSA) formed from polyisobutylene (number average molecular weight=1300) and tetraethylene pentamine (TEPA) in a mole ratio of 1.8:1 were reacted at 165°–170° C. for 4 hours and then mineral oil added. In a second stage reaction, maleic anhydride (MA) was added to the first stage reaction product in an amount equivalent to 0.14 moles per mole of TEPA used in the first stage and the resultant mixture was heated at 165°–170° C. for 1½ hours. The temperature was reduced to 150° C. and boric acid (2.2 moles per mole of TEPA) was added. After stirring for 30 minutes, phosphorous acid (0.5 moles per mole of TEPA) was added and the mixture stirred for a further 30 minutes. A vacuum of 40 mm of Hg was then applied and the mixture stripped for 1½ hours. A further charge of mineral oil is then made and the product filtered to give an additive concentrate with a nitrogen content of 1.51%, a phosphorus content of 0.20%, and a boron content of 0.56%.

EXAMPLE 8

The procedure of Example 7 is repeated except that in the third stage, the amount of $H_3PO_3$ is reduced to 0.25 moles per mole of TEPA used in the first stage reaction. The product on dilution has a nitrogen content of 1.46% and a phosphorus content of 0.20%, and a boron content of 0.63%.

EXAMPLE 9

In the first stage reaction, polyisobutenylsuccinic anhydride (PIBSA) (number average molecular weight=1300) and TETA are reacted in a mole ratio of 2.0:1. In a second stage, maleic anhydride is added to the first stage reaction product in an amount equivalent to 0.30 mole per mole of TETA used in the first stage and the resultant mixture is heated at 165°–170° C. for 1½ hours after which mineral oil is added. In a third stage reaction, boric acid and phosphorous acid are added to the second stage reaction product in amounts equivalent to 1.0 moles per mole of TETA used in the first stage and the resultant mixture is heated at 150°–155° C. for 3 hours. The product has a nitrogen content of 1.45% and a phosphorus content of 0.80%, and a boron content of 0.25%.

In order to determine the compatibility of various succinimide dispersants with fluoroelastomers, a series of finished crankcase lubricating oils for use in internal combustion engines containing various substituted succinimide dispersants were formulated. Each such oil contained, in addition to the succinimide dispersant, conventional amounts of over-based sulphonates, zinc dialkyl dithiophosphate, antioxidant, viscosity index improver, rust inhibitor, and antifoam agent to provide an SAE 15W/40 crankcase lubricant oil. The respective lubricants containing the succinimide dispersants of Examples 1–4 and 7–8 each contained an amount of such dispersant to provide a nitrogen content of 0.10%.

The resultant finished lubricating oils were subjected to the Volkswagen P.VW 3334 Elastomer Compatibility Test. The results wherein VITON AK6 fluoroelastomer was used are summarized in Table 1.

TABLE 1

| | Results of Fluoroelastomer Seal Tests | | |
|---|---|---|---|
| Succinimide Used | Change in Elongation to Break Compared to Fresh Seal, % | Change in Tensile Strength Compared to Fresh Seal, % | Cracking Observed |
| Example 1 | −8 | −11 | None |
| Example 2 | −24 | −22 | None |
| Example 3 | −24 | −36 | None |
| Example 4 | −19 | −18 | None |
| Example 7 | −30 | −26 | None |
| Example 8 | −22 | −22 | None |

In contrast, a corresponding untreated succinimide gives results in the above test in the order of −45% elongation change, −58% tensile strength change and it exhibits cracking.

Another feature of this invention is that the combined acylating, phosphorylation and boronation reactions, whether run serially in any order or concurrently, can yield products having lower viscosities and consequent improved handleability as compared to corresponding products formed using either acylation or boronation only. For example a succinimide formed as in the first stage of Example 1 and boronated with boric acid to a level of 1.6% boron (1.8% nitrogen) has a viscosity of approximately 2900 cSt at 100° C. A product formed by reacting PIBSA with TEPA and thereafter reacting the succinimide with maleic anhydride (MA) (mole ratios of PIBSA: TEPA: MA=2.05:1:1 (1.8% nitrogen) has a viscosity of 4500 cSt at 100° C. But a product of this invention formed from PIBSA, TEPA and MA (mole ratio: 1.8:1:0.3 respectively) and with a phosphorus content of 1.05% and boron content of 0.45% (1.8% nitrogen) had a viscosity at 100° C. of approximately 2160 cSt.

Additive concentrates of this invention generally contain 10 to 95 weight percent of one or more ashless dispersants of this invention, 0 to 90 weight percent liquid diluent and 0 to 90 weight percent of other additives commonly employed in lubricants and functional fluids.

The dispersants utilized according to the invention can be incorporated in a wide variety of lubricants. They can be used in lubricating oil compositions, such as automotive crankcase lubricating oils, automatic transmission fluids, or gear oils in effective amounts to provide active ingredient concentrations in finished formulations generally within the range of 0.5 to 10 weight percent, for example, 1 to 9 weight percent, preferably 2 to 8 weight percent, of the total composition. Conventionally, the dispersants are admixed with the lubricating oils as dispersant solution concentrates which usually contain up to about 50 weight percent of the active ingredient additive compound dissolved in mineral oil, preferably a mineral oil having an ASTM D-445 viscosity of 2 to 40, preferably 3 to 12 centistokes at 100° C. The lubricating oil not only can be hydrocarbon oils of lubricating viscosity derived from petroleum but also can be natural oils of suitable viscosities such as rapeseed oil, etc., and synthetic lubricating oils such as hydrogenated polyolefin oils; poly-α-olefins (e.g., hydrogenated or unhydrogenated α-olefin oligomers such as hydrogenated poly-1-decene); alkyl esters of dicarboxylic acids; complex esters of dicarboxylic acid, polyglycol and alcohol; alkyl esters of carbonic or phosphoric acids; polysilicones; fluorohydrocarbon oils; and mixtures or lubricating oils and synthetic oils in any proportion. The term "lubricating oil" for this disclosure includes all the foregoing. The useful dispersant may be conveniently dispersed as a concentrate of 10 to 80 weight percent of mineral oil, e.g., Solvent 100 Neutral oil with or without other additives being present and such concentrates are a further embodiment of this invention.

Other additives which may be included in the lubricants, functional fluids and additive concentrates of this invention include such substances as zinc dialkyl ($C_3$–$C_{10}$), dicycloalkyl ($C_5$–$C_{20}$), and/or diaryl ($C_6$–$C_{20}$) dithiophosphate wear inhibitors, generally present in amounts of about 0.5 to 5 weight percent. Useful detergents include the oil-soluble normal basic or overbased metal, e.g., calcium, magnesium, barium, etc., salts of petroleum naphthenic acids, petroleum sulfonic acids, alkyl benzene sulfonic acids, oil-soluble fatty acids, alkyl salicylic acids, sulphurized or unsulphurized alkyl phenates, and hydrolysed or unhydrolysed phosphosulphurized polyolefins. Gasoline engine crankcase lubricants typically contain, for example, from 0.5 to 5 weight percent of one or more detergent additives. Diesel engine crankcase oils may contain substantially higher levels of detergent additives. Preferred detergents are the calcium and magnesium normal or overbased phenates, sulphurized phenates or sulfonates.

Pour point depressants which may be present in amounts of from 0.01 to 1 weight percent in the lubricant or functional fluid include wax alkylated aromatic hydrocarbons, olefin polymers and copolymers, and acrylate and methacrylate polymers and copolymers.

Viscosity index improvers, the concentrations of which may vary in the lubricants from 0.2 to 15 weight percent, (preferably from about 0.5 to about 5 weight percent) depending on the viscosity grade required, include hydrocarbon polymers grafted with, for example, nitrogen-containing monomers, olefin polymers such as polybutene, ethylene-propylene copolymers, hydrogenated polymers and copolymers and terpolymers of styrene with isoprene and/or butadiene, polymers of alkyl acrylates or alkyl methacrylates, copolymers of alkyl methacrylates with N-vinyl pyrrolidone or dimethylaminoalkyl methacrylate, post-grafted polymers of ethylene-propylene with an active monomer such as maleic anhydride which may be further reacted with an alcohol or an alkylene polyamine, styrene/maleic anhydride polymers post-treated with alcohols and amines, etc.

Antiwear activity can be provided by about 0.01 to 2 weight percent in the oil of the aforementioned metal dihydrocarbyl dithiophosphates and the corresponding precursor esters, phosphosulphurized pinenes, sulphurized olefins and hydrocarbons, sulphurized fatty esters and alkyl polysulphides. Preferred are the zinc dihydrocarbyl dithiophosphates which are salts of dihydrocarbyl esters of dithiophosphoric acids.

Other additives include effective amounts of friction modifiers or fuel economy additives such as the alkyl phosphonates as disclosed in U.S. Pat. No. 4,356,097, aliphatic hydrocarbyl substituted succinimides as disclosed in EPO 0020037, dimer acid esters, as disclosed in U.S. Pat. No. 4,105,571, oleamide, etc., which are present in the oil in amounts of 0.1 to 5 weight percent. Glycerol oleates are another example of fuel economy additives and these are usually present in very small amounts, such as 0.05 to 0.2 weight percent based on the weight of the formulated oil.

Antioxidants are also usually employed in the additive concentrates and lubricants and functional fluids of this invention. Preferred are hindered phenolic antioxidants, methylene bridged alkylphenols, secondary aromatic amines, sulphurized phenols, alkyl phenothiazines, substituted triazines and ureas, and copper compounds such as copper naphthenate and copper oleate, among others. Typically the oil of lubricating viscosity will contain 0.001 to 2.5 weight percent of antioxidant. Particularly preferred are combinations of (i) at least one oil-soluble mononuclear monohydric phenol having a tertiary alkyl group in at least one position ortho to the hydroxyl group and a hydrogen atom or a tertiary alkyl group in the position para to the hydroxyl group, (ii) at least one oil-soluble methylene-bridged tertiary alkyl-substituted polyphenol, and (iii) at least one oil-soluble aromatic secondary amine, the proportions of (i), (ii) and (iii) being such that the weight percentage of nitrogen in component (iii) relative to the total weight of components (i), (ii) and (iii) is in the range of 0.05% to 1.5%, and the weight ratio of monohydric phenols:methylene-bridged polyphenols in the composition is in the range of 15:1 to 1:2. Preferably component (i) in the foregoing composition is an oil-soluble mixture of said mononuclear monohydric phenols. It is likewise preferred that component (ii) of the foregoing composition be an oil-soluble mixture of said methylene-bridged tertiary alkyl-substituted phenols.

Particularly preferred is an antioxidant composition which comprises a combination of (i) an oil soluble mixture of sterically-hindered tertiary alkylated monohydric phenols, (ii) an oil-soluble mixture of sterically-hindered tertiary alkylated methylene-bridged polyphenols, and (iii) at least one oil-soluble aromatic secondary amine, the proportions of (i), (ii) and (iii) being such that the weight percentage of nitrogen in component (iii) relative to the total weight of components (i), (ii) and (iii) is in the range of 0.05% to 1.5%, preferably in the range of 0.1% to 0.8%, and most preferably in the range of 0.3% to 0.7%, and the weight ratio of monohydric phenols:methylene-bridged polyphenols in the composition is in the range of 15:1 to 1:2, preferably in the range of 10:1 to 1:1, and most preferably in the range of 5:1 to 1:1. Preferred secondary aromatic amines are alkyl diphenylamines containing 1 or 2 alkyl substituents each having up to about 16 carbon atoms, phenyl-α-naphthylamine, phenyl-β-naphthylamine, alkyl- or aralkyl-substituted phenyl-α-naphthylamine containing 1 or 2 alkyl or aralkyl groups each having up to about 16 carbon atoms, alkyl- or aralkyl-substituted phenyl-β-naphthylamine containing 1 or 2 alkyl or aralkyl groups each having up to about 16 carbon atoms, and similar compounds. One such preferred compound is available commercially as Naugalube 438L, a material which is understood to be predominantly a 4,4'-dinonyldiphenylamine (i.e., bis(4-nonylphenyl)amine) wherein the nonyl groups are branched.

Other well known components such as rust inhibitors, wax modifiers, foam inhibitors, copper passivators, sulphur scavengers, seal swell agents, color stabilizers, and like materials can be included in the compositions of this invention, provided of course that they are compatible with the ashless dispersant of this invention and the other component or components being employed.

This invention also includes among its embodiments improved methods of lubricating mechanical parts in the presence of at least one fluoroelastomer surface. In the practice of such methods, the lubrication is effected by means of a lubricating oil or functional fluid containing an ashless dispersant of this invention. The practice of such methods results in a lower—oftentimes a substantially lower—amount of degradation of the fluoroelastomer contacted by the lubricating oil or functional fluid containing such ashless dispersant as compared to the amount of degradation that would occur under the same conditions using the same oil or fluid composition containing the same total quantity of the corresponding initial untreated ashless dispersant.

In another of its forms this invention provides in combination, (a) a mechanical mechanism containing moving parts to be lubricated, (b) a lubricating oil or functional fluid composition for lubricating such parts, and (c) a fluoroelastomer in contact with at least a portion of such lubricating oil or functional fluid during operation of such mechanism, characterized in that the lubricating oil or functional fluid composition for effecting such lubrication contains an ashless dispersant of this invention. Such utilization of this invention results in improvements in fluoroelastomer compatibility and enhanced antiwear performance, especially under actual service conditions. Among the mechanical mechanisms and systems lubricated in this manner are the crankcases of internal combustion engines; vehicular transmissions; hydraulic systems; hypoid axles; mechanical steering drives in passenger cars, in trucks, and in cross-country vehicles; planetary hub reduction axles and transfer gear boxes in utility vehicles such as trucks; pinion hub reduction gear boxes; synchromesh and synchronizer type gear boxes; power take-off gears; and limited slip rear axles. The ashless dispersant can also be utilized in metal working, machining, and cutting oils such as are applied to work pieces during cutting and shaping operations.

What is claimed is:

1. An oil soluble dispersant composition formed by reacting a basic nitrogen-containing ashless dispersant (i) with at least one dibasic acylating agent containing up to 12 carbon atoms per molecule, (ii) with at least one phosphorus compound, and (iii) with at least one boron compound, said reactions (i), (ii) and (iii) being conducted concurrently or sequentially in any order such that the ashless dispersant is chemically modified via acylation in (i), by phosphorylation in (ii) and by boronation in (iii).

2. A composition of claim 1 wherein the reaction identified as (i) is conducted prior to the reactions identified as (ii) and (iii).

3. A composition of claim 1 wherein the reactions identified as (ii) and (iii) are conducted prior to the reaction identified as (i).

4. A composition of claim 1 wherein the reactions identified as (i), (ii) and (iii) are conducted concurrently.

5. A composition of claim 1 wherein the reaction identified as (ii) is conducted using (a) at least one phosphorus acid or anhydride or ester thereof, or (b) any combination thereof; and wherein the reaction identified as (iii) is conducted using (a) at least one boron acid or anhydride or ester thereof, or (b) any combination thereof.

6. A composition of claim 5 wherein the acylating agent used in the reaction identified as (i) is maleic anhydride, maleic acid, fumaric acid, malic acid or a combination of any two or any three or all four of the foregoing.

7. A composition of claim 6 wherein the initial basic nitrogen-containing dispersant is a succinimide dispersant having an average of at least 3 nitrogen atoms per molecule.

8. A composition of claim 6 wherein the initial basic nitrogen-containing dispersant is a succinimide dispersant formed from an alkyl or alkenyl succinic acylating agent having an average of at least 40 carbon atoms in the alkyl or alkenyl group and an alkylene polyamine mixture having an average of at least 3 nitrogen atoms per molecule.

9. A composition of claim 6 wherein the initial basic nitrogen-containing dispersant is a succinimide dispersant formed from a polyisobutenyl succinic acylating agent derived from polyisobutene having a number average molecular weight in the range of 500 to 10,000 and an ethylene polyamine mixture including cyclic and acyclic structures, said mixture having an average overall composition approximating a mixture in the range of from triethylene tetramine to pentaethylene hexamine.

10. A composition of claim 9 wherein the dibasic acylating agent(s) is/are employed in amounts ranging from about 0.01 to about 0.5 moles per average equivalent of nitrogen in the initial ashless dispersant(s), with the proviso that the resultant product contains at least 0.05 equivalent of basic nitrogen, and wherein the phosphorus and boron compound(s) is/are employed in amounts sufficient to introduce up to about 5% of phosphorus and up to about 5% of boron, expressed as weight % of elemental phosphorus and weight % of elemental boron, into the overall final co-reacted dispersant.

11. A composition of as in claim 9 wherein the dibasic acylating agent(s) is/are employed in amounts such that the total mole ratio of (a) dibasic acylating plus (b) the alkenyl succinic acylating agent used in forming the initial succinimide falls in the range of from 1.5 to 3.5 moles of (a) and (b) per mole of polyamine; wherein the phosphorus compound(s) is/are employed in amounts sufficient to introduce from 0.05 to 2.5% of phosphorus, expressed as weight % of elemental phosphorus, into the overall final co-reacted dispersant; and wherein the boron compound(s) is/are employed in amounts sufficient to introduce from 0.05 to 2.5% of boron, expressed as weight % of elemental boron, into the overall final co-reacted dispersant.

12. A lubricating oil or functional fluid composition comprising a major proportion of an oil of lubricating viscosity and a minor dispersant amount of the dispersant of claim 1.

13. An additive concentrate containing the dispersant of claim 1.

14. A process which comprises reacting a basic nitrogen-containing ashless dispersant with at least one dibasic acylating agent having up to 12 carbon atoms in the molecule and with at least one phosphorus compound and with at least one boron compound, such reactions being conducted concurrently or sequentially in any order such that the ashless dispersant is chemically modified via acylation, phosphorylation and boronation.

15. A process as in claim 14 wherein the basic nitrogen-containing dispersant subjected to the process is a succinimide dispersant formed from an alkyl or alkenyl succinic acylating agent having an average of at least 40 carbon atoms in the alkyl or alkenyl group and an alkylene polyamine mixture having an average of at least 3 nitrogen atoms per molecule.

16. A process as in claim 14 wherein the initial basic nitrogen-containing dispersant is a succinimide dispersant formed from a polyisobutenyl succinic acylating agent derived from polyisobutene having a number average molecular weight in the range of 500 to 10,000 and an ethylene polyamine mixture including cyclic and acyclic structures, said mixture having an average overall composition approximating a mixture in the range of from triethylene tetramine to pentaethylene hexamine.

17. A method of lubricating mechanical parts in the presence of at least one fluoroelastomer surface wherein the lubrication is effected by means of a lubricating oil or functional fluid containing an ashless dispersant in accordance with claim 10.

18. Apparatus which comprises (a) a mechanical mechanism containing moving parts to be lubricated, (b) a lubricating oil composition for lubricating such parts, and (c) a fluoroelastomer in contact with at least a portion of such lubricating oil during operation of such mechanism, characterized in that the lubricating oil contains an ashless dispersant in accordance with claim 11.

19. A process of reducing the antagonism of a basic nitrogen-containing dispersant toward fluoroelastomers which comprises heating the dispersant concurrently or sequentially in one or more separate stages in any order with (i) at least one dibasic acylating agent having up to 12 carbon atoms in the molecule, (ii) at least one phosphorus compound, and (iii) at least one boron compound at a temperature in the range of 80° to 200° C. so that the resultant boron- and phosphorus-containing acylated product composition exhibits reduced fluoroelastomer antagonism.

20. A boron- and phosphorus-containing acylated product composition formed by the process of claim 19.

* * * * *